United States Patent [19]

Lovell

[11] Patent Number: 4,710,142

[45] Date of Patent: Dec. 1, 1987

[54] PROPELLER SHAFT BEARING ASSEMBLY

[76] Inventor: Roger Lovell, P.O. Drawer 760, Palacios, Tex. 77465

[21] Appl. No.: 721,433

[22] Filed: Apr. 9, 1985

[51] Int. Cl.[4] ..... B63H 23/34

[52] U.S. Cl. ..... 440/83; 440/82; 384/97; 384/98; 384/295

[58] Field of Search ..... 440/82, 83, 76, 78, 440/112; 384/97, 98, 125, 297, 295, 474, 475, 13, 42; 308/5 R; 114/169, 79

[56] References Cited

U.S. PATENT DOCUMENTS

| | | | |
|---|---|---|---|
| 2,324,863 | 7/1943 | Merchant | 384/97 |
| 2,416,519 | 2/1947 | Fountain et al. | 440/112 |
| 2,840,425 | 6/1958 | Howell | 384/97 |
| 3,302,988 | 2/1967 | Senter | 384/97 |
| 3,362,765 | 1/1968 | Pierce | 384/125 |
| 3,407,779 | 10/1968 | Satterwaite et al. | 440/83 X |
| 3,578,826 | 5/1971 | Janiszewski | 308/5 R X |
| 3,718,209 | 2/1973 | Moslo | 384/13 X |
| 4,473,308 | 9/1984 | Kramer | 384/98 |

*Primary Examiner*—Joseph F. Peters, Jr.
*Assistant Examiner*—Paul E. Salmon
*Attorney, Agent, or Firm*—Albert L. Gabriel

[57] ABSTRACT

A multi-layered sleeve bearing supports the propeller shaft of a propeller-driven water craft, the layered sleeves comprising an outer fixed master housing, an intermediate removable bearing housing, and an innermost bearing sleeve press-fitted in the removable bearing housing, such that when the bearing sleeve is worn past use, it may be replaced under water by removing the propeller from its shaft and sliding the bearing housing along with the worn bearing sleeve off of the shaft, taking the bearing housing above water and replacing the bearing sleeve within the bearing housing, and then replacing the bearing housing within the master housing under water. The procedure avoids the removal of rudder shaft or rudder as well as the necessity of dry docking the craft.

11 Claims, 4 Drawing Figures

FIG. 1
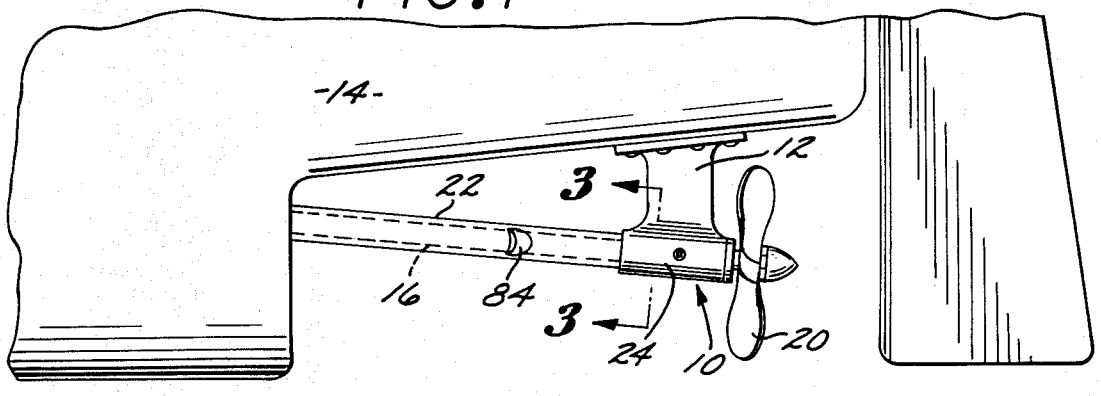
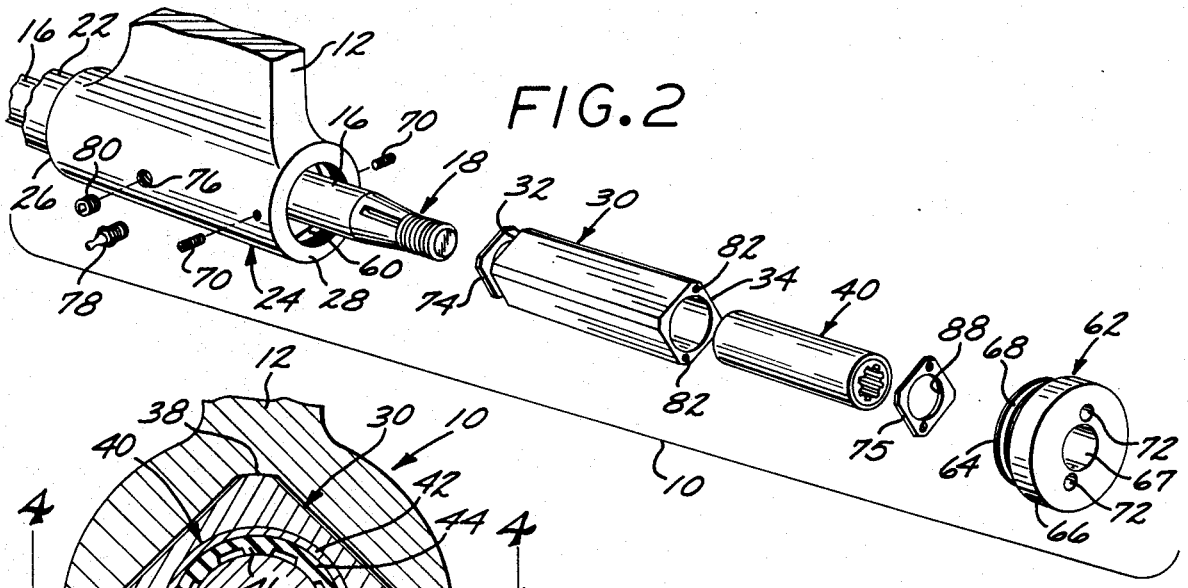
FIG. 2
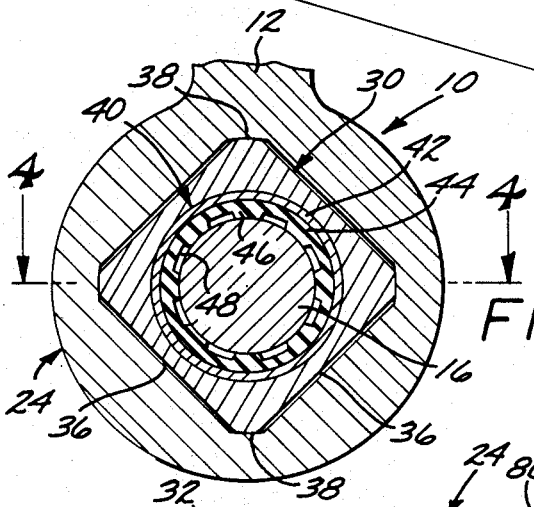
FIG. 3
FIG. 4
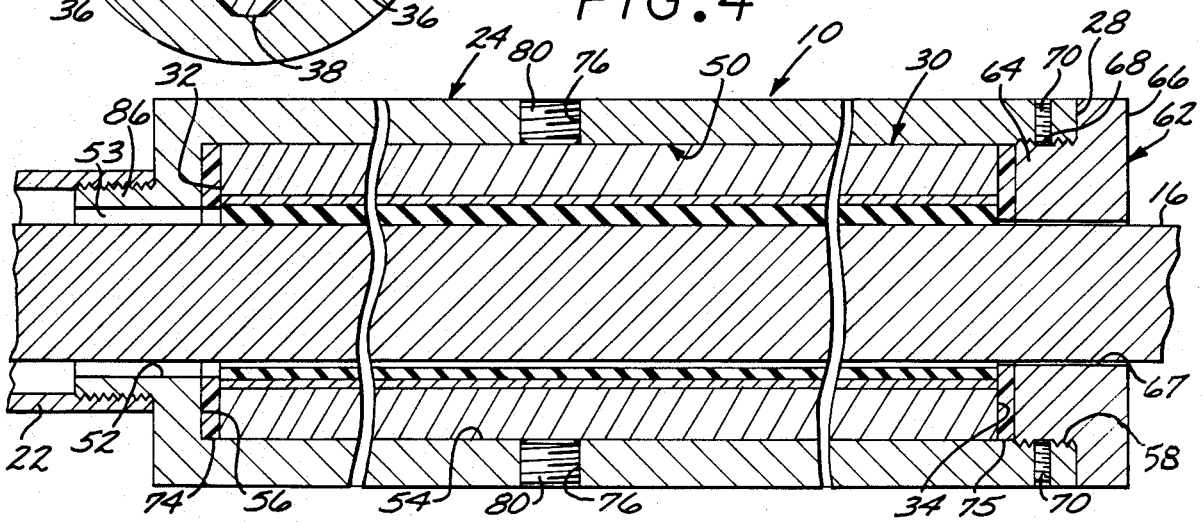

PROPELLER SHAFT BEARING ASSEMBLY

BACKGROUND OF THE INVENTION

1. Field of the Invention

The present invention relates to propeller-driven water craft and particularly to propeller shaft bearings of the same.

2. Description of the Prior Art

For propeller-driven water craft, a rotating propeller shaft is required, necessitating in turn a bearing system that diminishes frictive erosion about the shaft and its environment. The bearings take the shape of sleeves located along the length of the shaft between the mooring of the shaft located in the hull of the craft and the propeller located at the extreme of the shaft. The bearing sleeve may be fixed in place along the shaft either in the hull proximate the mooring or in a propeller support strut depending from the keel of the craft. In either case the prior art relies on such a bearing sleeve tightly fitted inside a fixed housing. Ordinary use of the craft will eventually wear the shaft bearing past its usable life, requiring the bearing's replacement.

Replacement of the prior art devices is a demanding task. The fixed position of the bearing housing and consequently the bearing itself makes removal of the shaft unavoidable if the bearing is to be accessed. In order to remove the shaft, which is in direct line with the rudder on a single propeller craft, the rudder assembly must first be removed, then the propeller, and finally the shaft. This procedure requires dry docking the craft. After the shaft is removed, the worn bearing must be manually driven out of place using a chisel and sledge hammer or, if this is not possible, burned out. The new bearing is then hammered into place and shaft, propeller and rudder replaced. The entire procedure requires several days in dry dock and several thousands of dollars in expenses.

Applicant is not aware of any prior art bearing system which eliminated the necessity of removing the shaft, the rudder, or placing the boat in dry dock.

SUMMARY OF THE INVENTION

In view of these and other problems in the art, it is a general object of the present invention to provide a bearing system for propeller-driven water craft which enables propeller shaft bearing replacement without requiring that the craft be removed from the water and placed in dry dock.

It is another object of the invention to provide a bearing system of the character described wherein bearing replacement does not require removal of the rudder assembly.

Another object of the invention is to provide a bearing system of the character described wherein bearing replacement does not require removal of the propeller shaft.

A further object of the invention is to provide a bearing system of the character described wherein the bearing assembly comprises a multi-layered sleeve configuration.

Still another object of the invention is to provide a bearing system of the character described wherein the outer sleeve comprises a fixed master housing.

Yet a further object of the invention is to provide a bearing system of the character described wherein the outer sleeve of the master housing nonrotatably supports therein an inner sleeve defining a removable bearing housing.

Yet another object of the invention is to provide a bearing system of the character described wherein the removable inner bearing housing may be taken out of the outer master housing and slid off the propeller shaft while the boat is in the water, and then taken above water for replacement of a worn bearing sleeve.

A still further object of the invention is to provide a bearing system of the character described wherein the removable bearing housing resists rotation within the master housing due to an out-of-round exterior configuration of the bearing housing and its fit within the compatible bore of the master housing, such configuration preferably being substantially square in cross-section.

Yet a further object of the invention is to provide a bearing system of the character described wherein the removable bearing housing and the bearing sleeve therein are retained within the master housing by means of a housing cap threadedly mounted on one end of the master housing.

The propeller shaft bearing assembly of the invention comprises a multi-layered sleeve configuration comprising an outer fixed master housing, an inner removable bearing housing, and an innermost bearing sleeve, preferably of the water-lubricated Cutlass type, which prevents the frictive erosion of a propeller shaft as the shaft rotates about its longitudinal axis during operation of the propeller. The outer housing has a reduced diameter bore proximate one end and a cap threaded onto the other end in order to retain the removable bearing housing and bearing sleeve within the master housing. The propeller shaft passes through the longitudinal axis of the bearing assembly. The bearing assembly is fixed along the propeller shaft intermediate the shaft mooring and the propeller, preferably being supported on the bottom of a hydrodynamically contoured strut extending downwardly from the hull.

Provision is made for filling the clearances between the outer master housing and the removable inner housing with grease so as to prevent internal corrosion and entry of foreign material such as mud, thereby assuring easy removal and replacement of the inner housing and its contained bearing sleeve, despite the adverse underwater environment.

When the bearing sleeve is worn past use, it is replaced underwater by removing the propeller, disconnecting the housing cap from the outer housing, and drawing the bearing housing and bearing sleeve that it contains along the shaft and off the propeller end of the shaft. The bearing housing and contained bearing sleeve may then be taken above water level, and the old bearing sleeve removed and replaced with and a new bearing sleeve utilizing a standard press machine used conventionally in shipyards. The bearing housing and bearing sleeve may then be replaced in the outer housing underwater and secured within the outer housing by the end cap and the propeller replaced on the propeller shaft in the conventional manner. This procedure does not require that the craft be dry docked or that the propeller shaft or rudder be removed.

BRIEF DESCRIPTION OF THE DRAWINGS

These and other objects of the invention will become more apparent in view of the following description taken in conjunction with the drawings, wherein:

FIG. 1 is a perspective view of the bearing assembly of the present invention as it is attached along the propeller shaft of a propeller-driven water craft.

FIG. 2 is an exploded perspective view of the bearing assembly of the present invention.

FIG. 3 is a transverse sectional view taken on line 3—3 in FIG. 1.

FIG. 4 is an axial sectional view taken on line 4—4 in FIG. 3.

DETAILED DESCRIPTION

Referring to the drawings, the propeller shaft bearing assembly of the present invention is generally designated 10, and as best seen in FIG. 1 the propeller shaft is journalled in the bearing assembly 10 just forward of the propeller. The bearing assembly 10 is preferably supported on the lower end of a vertical strut 12 extending downwardly from the bottom of the boat hull 14 near its stern, the strut 12 being hydrodynamically contoured to minimize drag in the water.

The propeller shaft 16 journalled in bearing assembly 10 has the usual propeller mounting section 18 at its rear end just aft of bearing assembly 10, and propeller 20, sometimes referred to as a "wheel," is removably mounted on mounting section 18. The propeller shaft 16 is encased within a shaft tube or pipe 22 from hull 14 to bearing assembly 10 which serves both to protect the propeller shaft 16 and to supply a flow of lubricating and cleansing water to within the bearing assembly 10.

Bearing assembly 10 comprises four principal parts, an outer or master housing, an inner bearing housing slip-fitted into the outer housing, a cutlass bearing insert retained within the inner bearing housing, and a rear end cap. The outer or master housing is generally designated 24, and is preferably integrally formed on the lower end of strut 12. Outer housing 24 is preferably made of stainless steel, and preferably has a substantially cylindrical external configuration, with front and rear ends 26 and 28, respectively.

The inner bearing housing is generally designated 30, and is also preferably made of stainless steel. It is somewhat shorter than outer housing 24 so as to fit entirely within outer housing 24, and has an out-of-round transverse configuration, preferably substantially square, to secure it against being rotated by rotational movement of the propeller shaft 16. Inner bearing housing 30 is removably slip-fitted into outer housing 24 from the rear end 28 of outer housing 24. Inner bearing housing 30 has front and rear ends 32 and 34, respectively. With the preferred substantially square transverse cross-sectional configuration, inner bearing housing 30 has four flat sides 36 arranged in diagonally opposed pairs, and four preferably truncated apexes 38 arranged in horizontally and vertically opposed pairs. The Cutlass bearing 40 is a type of bearing well known to those in the art, and comprises a bronze outer shell 42 with a hard rubber insert 44 bonded to the inside of outer shell 42, insert 44 having a series of longitudinal ribs 46 which define longitudinal channels 48 therebetween. The Cutlass bearing 40 is a water lubricated and cleansed type of bearing through which water is longitudinally flowed, as described in detail hereinafter in connection with a description of the operation of the bearing assembly 10 of the invention. The Cutlass bearing insert 40 is press-fitted within the inner bearing housing 30 and is coextensive in length with the inner bearing housing 30.

Outer or master housing 24 has a bore generally designated 50 extending longitudinally therethrough from its front end 26 to its rear end 28. This bore 50 is stepped in three sections. Thus, there is a cylindrical annular forward bore section 52 that is somewhat greater in diameter than the propeller shaft 16 to provide a clearance 53 through which lubricating and cleansing water is provided within the Cutlass bearing insert 40. Forward bore section 52 is short in axial extent, and immediately to the rear thereof is an insert bore section 54 which extends through most of the length of outer housing 24 and has an out-of-round cross-sectional configuration which is complementary to the cross-sectional configuration of inner bearing housing 30 so as to lock the inner bearing housing 30 against rotational movement. In the preferred form of the invention which is illustrated, this elongated insert bore section 54 has a substantially square cross-section with truncated corners matching the cross-section of inner bearing housing 30. The square insert bore section 54 is a counterbore relative to forward bore section 52 so as to define a rearwardly facing shoulder 56 between bores 52 and 54.

A short annular cap-receiving bore section 58 at the rear end of outer housing 24 is a counterbore to the square insert bore section 54, providing a rearwardly facing shoulder 60 between bore sections 54 and 58. The rear bore section 58 is internally threaded to receive the complementary externally threaded plug section 64 of a rear end cap 62. Cap 62 is preferably made of stainless steel and has a rear flange section 66 extending radially outwardly from the plug section 64, flange section 66 seating against the rear end surface 28 of outer housing 24. Rear end cap 62 has a central axial bore 67 through which propeller shaft 16 extends and which is slightly greater in diameter than the propeller shaft 16 so as to allow the rearward exit flow of lubricating and cleansing water from the Cutlass bearing insert 40. An annular set screw groove 68 is provided on plug section 64 to receive a pair of diametrically opposed set screws 70 for locking the rear end cap 62 in its operative position on the bearing assembly 10 as best illustrated in FIG. 4. A pair of spaced wrench holes 72 is provided in the rearwardly facing surface of end cap 62 to receive complementary projections on a torquing tool.

An elastomeric grease seal 74, preferably made of Neoprene, is fitted between the rearwardly facing shoulder 56 of outer housing 24 and the front end 32 of inner bearing housing 30 and the registering front end of Cutlass bearing insert 40. The outer configuration of grease seal 74 corresponds to the internal cross-sectional configuration of square insert bore section 54, while the inner configuration of grease seal 74 is annular and registers approximately with the forward bore section 52 to provide a continuation of the clearance 53 between bore section 52 and propeller shaft 16 for the passage of lubricating and cleansing water to the Cutlass bearing insert 40. A rearward grease seal 75 is of similar material and similar configuration to the forward grease seal 74 having an outer configuration corresponding with the cross-section of square insert bore 54 and an inner annular configuration approximately registering with the central bore 67 of rear end cap 62.

The clearances between the outside of inner bearing housing 30 and the square insert bore section 54 are preferably filled with grease to lubricate rearward extraction movement of the inner bearing housing 30 from the outer housing 24, and to prevent corrosion and the accumulation of mud or other foreign materials in this region, which would otherwise make extraction of the inner bearing housing 30 from outer housing 24 more difficult. A pair of horizontally opposed, threaded grease holes 76 is provided through the wall of outer housing 24 proximate the longitudinal center thereof. A grease nipple fitting 78 is threadedly engaged in one of these grease holes 76, and grease is pumped through such nipple 78 until grease comes out of the opposite grease hole 76, indicating that the clearance between inner bearing housing 30 and the square insert bore section 54 of outer housing 24 is completely filled with grease. Then, the grease nipple fitting 78 is removed from its hole 76, and both grease holes 76 are plugged with grease plugs 80. Removal of the externally greased inner bearing housing 30 from the square insert bore section 54 is facilitated by engagement of a suitable extractor tool in a pair of diametrically opposed threaded extractor holes 82 in the rear end of inner bearing housing 30 proximate an opposed pair of the apexes.

The rear end of propeller shaft tube 22 is engaged over a nipple 86 on the front end of outer housing 24, and is connected as by means of a threaded connection to secure the rear end of shaft tube 22 to the front end of outer housing 24 for channeling pressurized water from shaft tube 22 into the inside of the bearing assembly 10.

A pair of water scoops 84 is located on opposite sides of the propeller shaft tube 22 for scooping water through registering holes in opposite sides of shaft tube 22 under the pressure of forward movement of the hull 14 and rearward water flow caused by rotation of the propeller 20. Thus, water is forced rearwardly under such pressure through the annular clearance between propeller shaft 16 and the inside of shaft tube 22, being then forced rearwardly through the forward clearance 53 into the Cutlass bearing 40 to lubricate and cleanse the bearing 40, this water then leaving through the rearward annular clearance between the propeller shaft 16 and the central bore 67 of rear end cap 62.

The bearing assembly 10 of the present invention is assembled by first press-fitting the Cutlass bearing insert 40 into the inner bearing housing 30 by a conventional press machine available at all shipyards, and then slip-fitting the inner bearing housing 30 and its contained Cutlass bearing 40, with the grease seal 74 ahead of it, into the square insert bore 54 of outer housing 24. Then the rear grease seal 75 is placed inside the rear end of square bore 54 and the rear end cap 62 is threadedly engaged in the cap-receiving bore section 58 until its flange 66 seats against the rear end 28 of outer housing 24. Such seating need not be tight, as the end cap 62 is locked against unthreading rotation by tightening the opposed set screws 70 against the set screw groove 68 in cap 62. Then, grease fitting 78 is engaged in one of the grease holes 76 and grease is forced into the clearance between inner bearing housing 30 and square bore section 54 until grease comes out of the other grease hole 76, and the grease nipple fitting 78 is removed and both grease holes 76 plugged by the grease plugs 80. Bearing assembly 10 is then fully operable, and all that remains to be done is to assemble the propeller 20 onto the mounting section 18 at the rear end of propeller shaft 16.

When the Cutlass bearing insert 40 is worn to the extent it needs to be replaced, the following steps are all that are necessary. First, the propeller 20 is removed from the propeller shaft 16. Next, the cap set screws 70 are backed out from engagement with rear end cap 62 and the cap 62 is screwed out of the rear end of outer housing 24. Rear grease seal 75 is then slipped rearwardly out of the rear end of outer housing 24, and threaded members of an extraction tool threadedly engaged in the extractor holes 82 in the rear end of inner bearing housing 30, and the inner bearing housing 30 is rearwardly extracted out of the outer housing 24. If desired, holes 88 may be provided through the rear grease seal 75 which register with extractor holes 82 in inner bearing housing 30, and the extractor tool may be engaged in the bearing housing 30 through these seal holes 88 and the rear seal 75 extracted along with the inner bearing housing 30. This disassembly procedure may readily be accomplished by an experienced diver while the boat is in the water, and without requiring removal of the rudder. Then, onshore, the old Cutlass bearing 40 is pressed out of the inner housing 30 and a new Cutlass bearing pressed into place, and the bearing assembly 10 is then reassembled as described in the preceding paragraph.

By thus being able to remove and replace the Cutlass bearing 40 in the bearing assembly 10 without having to either remove the hull 14 from the water or remove the rudder from the hull 14, great savings are realized in both work and material. Conventional prior art procedures eliminated with the present invention are removing the boat from the water, removing the rudder from the boat hull, pulling the propeller shaft out of its mooring, and with a chisel and a large sledge hammer driving the bearing out of its position, or alternatively burning the bearing out, then hammering the new bearing into place, replacing the propeller shaft and the shaft packing, realigning the shaft, reinstalling the rudder, and lowering the boat back into the water.

For large, twin-prop trawlers with which the applicant is familiar, it is estimated that the present invention will reduce the work time for replacing the Cutlass bearings from 2 to 3 days down to only approximately 3 hours, with a corresponding reduction in cost that is generally proportional.

While the invention has been described with reference to a presently preferred embodiment, it is to be understood that modifications or alterations may be made by those skilled in the art without departing from the scope and spirit of the present invention as set forth in the appended claims.

I claim:

1. A bearing assembly for a boat propeller shaft which comprises:

an outer housing having front and rear ends adapted to be rigidly secured to the boat hull and having first bore means therethrough, an inner housing removably axially slideably engagable in said outer housing bore means and having second bore means therethrough, bearing sleeve means removably fixedly secured within said second bore means within which said propeller shaft is adapted to be journalled, and front end rear apertured shoulder means on the ends of said outer housing for axially retaining said inner housing and bearing sleeve within said outer housing, said rear shoulder means being removably attached to said outer housing allowing for removal of said inner housing and bearing sleeve means from said outer housing, replacement of said bearing sleeve means in said inner housing, and then replacement of said inner housing and bearing sleeve means in said outer housing, said first bore means and the outer periphery of said inner housing having complementary out-of-round cross-sectional configuration along their lengths preventing rotational movement of said inner housing and bearing sleeve means in said outer housing.

2. A bearing assembly as defined in claim 1, wherein said removable shoulder means comprises a rear end cap threadedly engageable on the rear end of said outer housing.

3. A bearing assembly as defined in claim 2, wherein said end cap has a threaded plug section threadedly engageable within the rear end of said outer housing, and set screw means in said outer housing engageable against said plug section to releasably lock said end cap in position on said outer housing.

4. A bearing assembly as defined in claim 1, wherein said outer housing is adapted to be rigidly secured to the boat hull by hydrodynamically countoured strut means attachable to the hull.

5. A bearing assembly as defined in claim 1, wherein said bearing sleeve means comprises water-lubricated bearing means defining a series of water flow channels around its inner circumference for the axial flow of lubricating water between said bearing sleeve means and the propeller shaft, said first bore means of said outer housing having front and rear end portions that are larger in diameter than the propeller shaft so as to permit the rearward flow of lubricating water into, through, and out of said water flow channels.

6. A bearing assembly as defined in claim 5, which comprises shaft tube means surrounding the propeller shaft between the boat hull and said outer housing, the inside diameter of said shaft tube means being greater than the outside diameter of the propeller shaft to permit the flow of water through said tube means, and forwardly opening water scoop means on said shaft tube means for scooping lubricating water into said tube means for delivery to said water flow channels.

7. A bearing assembly as defined in claim 1, wherein there is clearance between said first bore means and the outer periphery of said inner housing means, and which comprises at least one grease port extending through the wall of said outer housing, and grease fitting means threadedly engageable in said port enabling grease to be pumped into said clearance.

8. A bearing assembly as defined in claim 7, which comprises a pair of said grease ports, with said grease fitting means being threadedly engageable in one of them, enabling grease to be pumped into said clearance through said one port until grease flows out of the other port indicating said clearance is filled with grease, and a pair of grease plugs threadedly engageable in said grease ports after said clearence is filled with grease and said grease fitting has been unthreaded from said one port.

9. A bearing assembly as defined in claim 8, which comprises elastomeric grease seal means within each end of said first bore means engaged between the ends of said inner housing and the respective said front and rear shoulder means.

10. A bearing assembly as defined in claim 1, wherein said out-of-round cross-sectional configurations are substantially square.

11. A bearing assembly as defined in claim 1, which comprises rearwardly opening threaded extractor hole means in the rear end of said inner housing for engagement of extractor tool means with said inner housing.

* * * * *